US005708694A

United States Patent [19]

Beyerlein et al.

[11] Patent Number: 5,708,694

[45] Date of Patent: Jan. 13, 1998

[54] X-RAY GENERATOR

[75] Inventors: Walter Beyerlein, Bubenreuth; Karsten Schmitt, Erlangen, both of Germany

[73] Assignee: Siemens Aktiengesellschaft, Munich, Germany

[21] Appl. No.: 787,331

[22] Filed: Jan. 28, 1997

[30] Foreign Application Priority Data

Feb. 23, 1996 [DE] Germany ..... 196 06 868.1

[51] Int. Cl.[6] ..... H05G 1/32

[52] U.S. Cl. ..... 378/112; 378/109; 378/110

[58] Field of Search ..... 378/108, 109, 378/110, 111, 112, 113

[56] References Cited

U.S. PATENT DOCUMENTS 4,809,311 2/1989 Arai et al. ..... 378/110

5,485,494 1/1996 Williams et al. ..... 378/110

OTHER PUBLICATIONS

"Patents Abstract of Japan," E-571, Jan. 9, 1988, vol. 12/No. 7 for Japanese application No. 60-269899.

*Primary Examiner*—Don Wong

*Attorney, Agent, or Firm*—Hill, Steadman & Simpson

[57] ABSTRACT

An x-ray generator wherein the tube current is kept constant independently of the drop in the cathode temperature after the radiation is switched on has a control circuit for the tube filament current in which a correction value that corresponds to the drop in the tube current given constant filament current during the radiation phase due to the drop in temperature of the cathode is superimposed on the rated value of the filament current at the beginning of radiation.

4 Claims, 3 Drawing Sheets

X-RAY GENERATOR

BACKGROUND OF THE INVENTION

1. Field of the Invention

The present invention is directed to an x-ray generator, which includes an x-ray tube and associated operating and control circuitry.

2. Description of the Prior Art

It is necessary in an x-ray generator to keep the dose rate of the primary radiation emitted by the x-ray tube constant. Given a constant tube voltage, the dose rate is directly proportional to the tube current. Control circuits for the tube voltage and for the cathode temperature of the x-ray tube, which determines the tube current, are present in known x-ray generators for keeping these quantities constant.

A problem is that, when the filament current is kept constant at a defined value for this purpose, the tube current drops from an initial value to a lower final value with the turn-on of the tube voltage.

These conditions are shown in FIGS. 1*a*, 1*b* and 1*c*. Curve 1 shows the time curve of the tube voltage. The x-ray tube is activated for generating radiation during the time T. Curve 2 shows the curve of the actual value of the filament current, this being constant. Curve 3 shows the desired curve of the rated value of the tube current. In fact, however, the tube current conforms to curve 4, i.e. it drops after the x-ray tube is turned on.

A further problem is that an actual value of the filament current is acquired while the appertaining tube current is in the steady state (during radiation) for various compensation procedures such as, for example, compensating variations of tube parameters caused by aging or by unit tolerance scatter. When the filament current of a "new" tube is used as a reference value, then the tube current does not agree with the reference value at the beginning of radiation.

U.S. Pat. No. 4,809,311 discloses an x-ray diagnostics apparatus wherein regulation of the filament current ensues in a pre-heating mode, i.e. before the beginning of radiation emission. The aforementioned drop in tube current during the radiation phase is not taken into account. Published Japanese Application 62-168 399 discloses a control circuit for the x-ray tube current wherein the drop in the x-ray tube current during the radiation phase is in fact taken into account but wherein, no details are provided regarding the determination of the required correction quantity.

SUMMARY OF THE INVENTION

An object of the present invention is to provide an x-ray generator with a control circuit for the tube filament current such that the described drop in the tube current after connection of the tube voltage (high voltage) is automatically avoided, with the determination of the correction quantity required therefor ensuing exactly.

The above object is achieved in accordance with the principles of the present invention in an x-ray generator containing an x-ray tube and a control circuit for regulating the x-ray tube filament current during emission of radiation by the x-ray tube, the control circuit including a calculating stage which, using operating parameters of the x-ray tube, determines a correction value for the reference value of the filament current, this correction value corresponding to a drop in the tube current given constant filament current during the emission of radiation, this drop in the tube current arising due to the temperature drop of the cathode. The correction value is then superimposed on the original reference value.

DESCRIPTION OF THE PREFERRED EMBODIMENTS

The change of the tube current during the radiation phase is caused by a cooling of the cathode temperature. This is in turn produced by the electron affinity of the electrons from the cathode during the radiation phase. First, this electron affinity is determined from known quantities. Further, its influence on the filament current is calculated and a correction quantity $\Delta I_{fil}$ is determined therewith. The aforementioned problems can be solved with this correction quantity. The electron affinity of the electrons from, for example, a tungsten coil amounts to 4.56 eV. This corresponds to a power of 4.56 W given a tube current of 1 A. The effective dissipated power that determines the coil temperature derives as follows:

$P_{coil}=I^2_{fil}\cdot R_{coil}$; without radiation $P_{coil}=I^2_{fil}\cdot R_{coil}-P_{out}\cdot I_{tube}/1$ A; with radiation.

$P_{out}$=electron affinity of the electrons from the cathode, referred to $I_{tube}$=1 A.

The correction value of the filament current needed for keeping the tube current $I_{tube}$ constant is calculated from the reduced coil heating capacity as follows:

$$\Delta I_{fil} = I_{fil} - \sqrt{I_{fil}^2 - \frac{I_{tube} * P_{out}}{1A * R_{coil}}} \quad (1)$$

This correction value can now be employed to solve the two problems addressed above.

When only one filament current regulator for setting the coil temperature is present, the tube current can now be kept constant. The compensation of the disturbing quantity, the electron affinity, is implemented as follows by applying the correction value at the time the radiation begins:

$$I_{fil\ ref}=I_{fil}+\Delta I_{fil} \quad (2)$$

FIG. 2 again shows the tube voltage. The above-described inventive additive application is shown in curve 5 (FIG. 2*b*). Curve 6 in FIG. 2*c* shows that the actual value of the tube current can be kept constant as a result.

Figure 3:
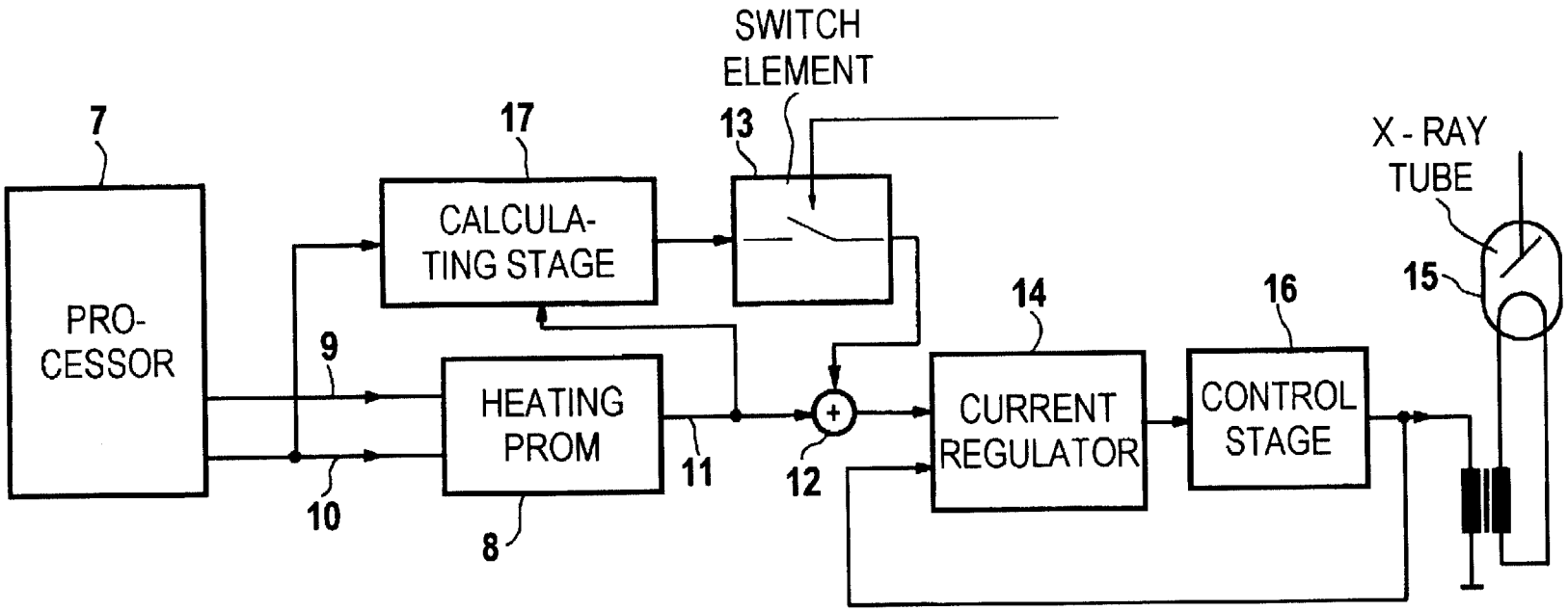
FIG. 3 is a block circuit diagram of a first embodiment of an x-ray generator constructed in accordance with the principles of the present invention.

FIG. 3 shows a processor 7 that supplies signals that correspond to the reference values for the tube voltage and the tube current to a heating PROM 8 at the inputs 9 and 10. As a result, a signal is called from the heating PROM 8 at the output 11, this signal corresponding to the reference value of the filament current and being supplied to an addition element 12. With the radiation shut off (switch element 13 open), this is the reference value for a filament current regulator 14 that correspondingly influences the filament current of the X-ray tube 15 via a control stage 16.

Figure 1A:
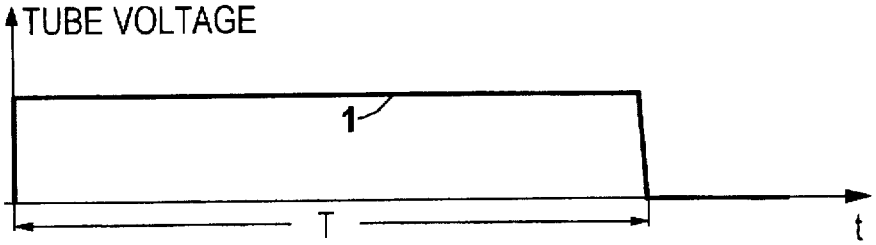
FIGS. 1*a*, 1*b* and 1*c*, as noted above, show the tube voltage and filament current in a conventionally-controlled x-ray tube in a conventional x-ray generator.
Figure 1B:
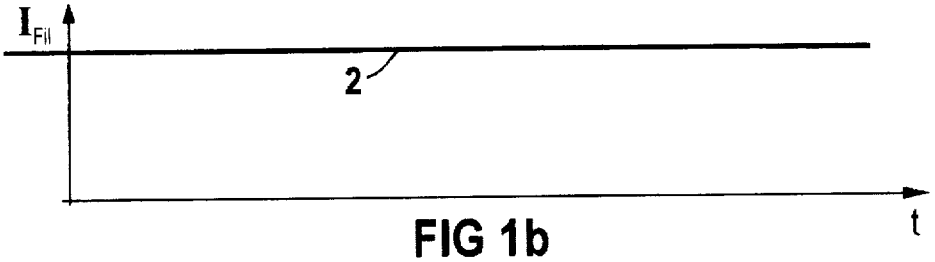
Figure 1C:
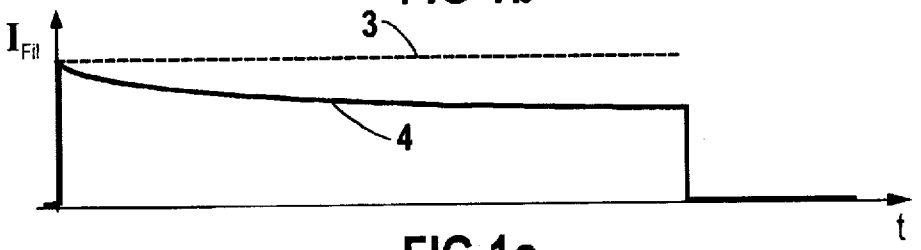
Figure 2A:
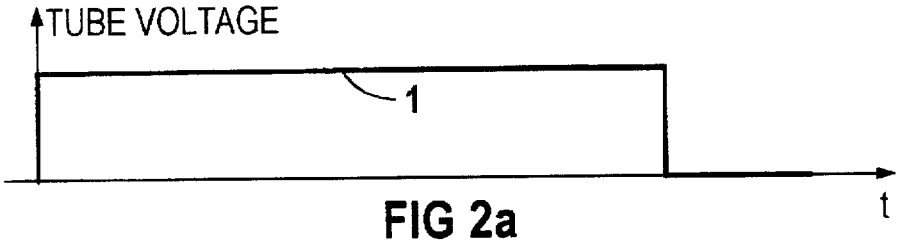
FIGS. 2*a*, 2*b* and 2*c* show the tube voltage and filament current in an x-ray tube controlled by a control circuit in an x-ray generator constructed and operated in accordance with the principles of the present invention.
Figure 2B:
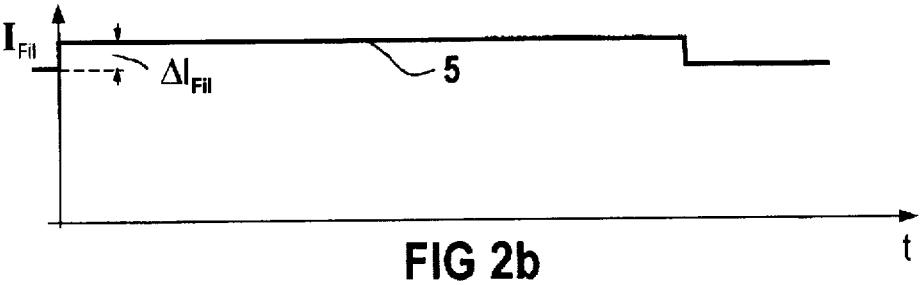
Figure 2C:
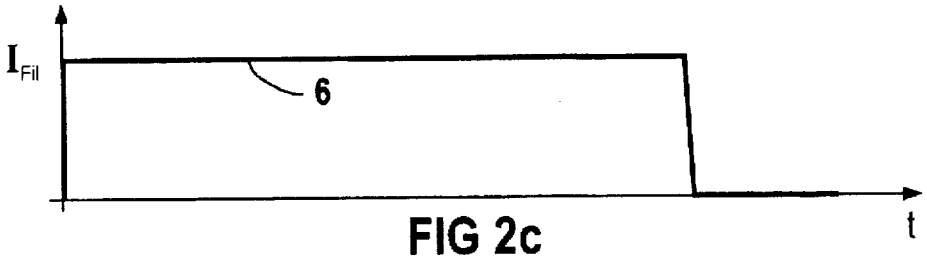

When the radiation is switched on, i.e. the switch element 13 is closed, then a correction value calculated by the calculating stage 17 according to equation (1) is superimposed on the reference value of the filament current by the addition element 12, and the correction described in conjunction with FIG. 2 and equation (2) ensues.

Figure 4:
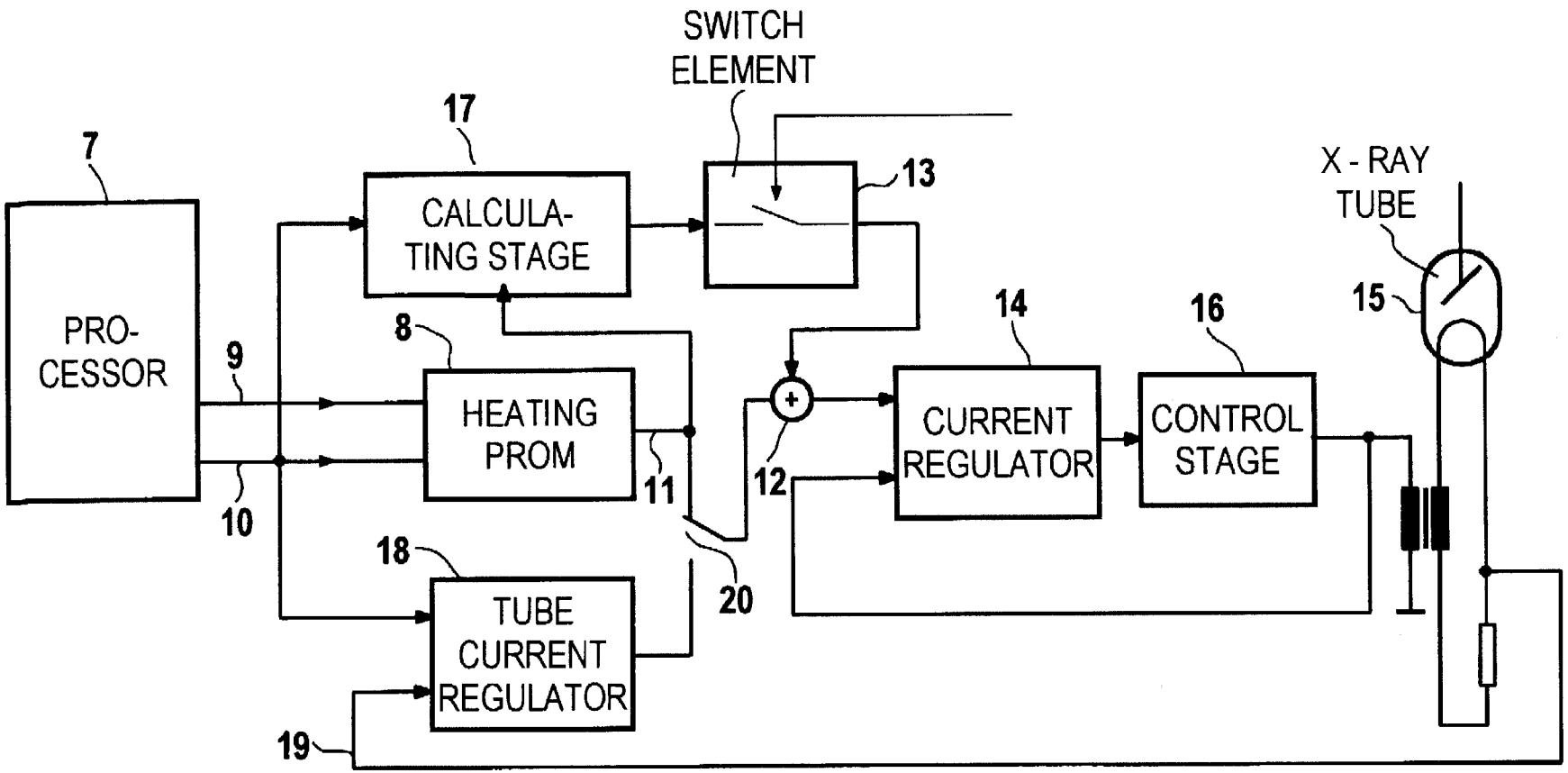
FIG. 4 is a block circuit diagram of a second embodiment of an x-ray generator constructed in accordance with the principles of the present invention.

FIG. 4 shows that, in addition to the filament current control circuit, a control circuit is also provided for the tube current, which includes a tube current regulator 18 with an actual value input 19. With the radiation switched on, a switch 20 is toggled down, so that regulation of the tube current ensues. In this case as well, the aforementioned correction value is additively superimposed on the reference value of the tube current in the addition element 12 in order to enhance the quality of the control. One can proceed similarly in the case of a dose rate regulator.

One can proceed according to the following strategy, which employs the correction value $\Delta i_{fil}$, for a compensation procedure that, for example, eliminates aging and unit scatter:

$I_{fil}$ prescription from the tube PROM $I_{tube\ actual}$ does not agree with the desired value (unit scatter, aging).

After a longer time delay, the tube current regulator brings the reference value into agreement with the actual value.

The actual value of the filament current is now determined.

For prescribing the filament current, the new reference value is derived as follows:

$$I_{fil\ ref}=I_{fil\ actual\ (old)}-\Delta I_{fil}$$

The $I_{tube\ actual}$ occurring at the next radiation activation immediately coincides with the reference value.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray generator comprising:

an x-ray tube having a cathode operable with a filament current, said x-ray tube during emission of radiation having operating parameters associated therewith including a tube current; and control means for regulating said filament current during emission of radiation, said control means including calculating means for, using said operating parameters, identifying a correction value for a filament current reference value which corresponds to a drop in said tube current, given constant filament current during emission of radiation due to a temperature drop of said cathode, and for superimposing said correction value on said reference value.

2. An x-ray generator as claimed in claim 1 wherein said calculating means comprises means for calculating said correction value, designated $\Delta i_{fil}$, according to $$\Delta I_{fil}=I_{fil}-\sqrt{I_{fil}^2-\frac{I_{tube}*P_{out}}{1A*R_{coil}}}$$

wherein $I_{tube}$ is the tube current, $P_{out}$ is an electron affinity of electrons from the cathode, and $R_{coil}$ is the resistance of said coil.

3. An x-ray generator comprising:

an x-ray tube having a cathode operable with a filament current, said x-ray tube during emission of radiation having operating parameters associated therewith including a tube current; and control means for regulating said tube current during emission of radiation, said control means including calculating means for, using said operating parameters, identifying a correction value for a tube current reference value which corresponds to a drop in said tube current, given constant filament current during emission of radiation due to a temperature drop of said cathode, and for superimposing said correction value on said reference value.

4. An x-ray generator as claimed in claim 3 wherein said calculating means comprises means for calculating said correction value, designated $\Delta i_{fil}$, according to $$\Delta I_{fil}=I_{fil}-\sqrt{I_{fil}^2-\frac{I_{tube}*P_{out}}{1A*R_{coil}}}$$

wherein $I_{tube}$ is the tube current, $P_{out}$ is an electron affinity of electrons from the cathode, and $R_{coil}$ is the resistance of said coil.

* * * * *